US008419014B2

(12) United States Patent
Yamagishi et al.

(10) Patent No.: US 8,419,014 B2
(45) Date of Patent: Apr. 16, 2013

(54) IMAGE READING APPARATUS, MULTIFEED DETERMINING METHOD, AND MULTIFEED DETERMINING PROGRAM

(75) Inventors: Hiroshi Yamagishi, Ishikawa (JP); Shinji Suzuki, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 13/048,575

(22) Filed: Mar. 15, 2011

(65) Prior Publication Data

US 2011/0278790 A1 Nov. 17, 2011

(30) Foreign Application Priority Data

May 14, 2010 (JP) ..... 2010-112445

(51) Int. Cl.
*B65H 7/12* (2006.01)

(52) U.S. Cl.
USPC ..... 271/262; 271/265.04; 271/258.01

(58) Field of Classification Search ..... 271/258.01, 271/262, 265, 304, 265.04
See application file for complete search history.

(56) References Cited

U.S. PATENT DOCUMENTS 7,255,343 B2 * 8/2007 So ..... 271/262
7,445,209 B2 * 11/2008 Sano et al. ..... 271/263
7,654,521 B2 * 2/2010 Simonis et al. ..... 271/262
7,866,666 B2 * 1/2011 Saikawa et al. ..... 271/265.04
7,950,657 B2 * 5/2011 Fushimi ..... 271/262
8,066,280 B2 * 11/2011 Simonis et al. ..... 271/262
2005/0184453 A1 * 8/2005 Sano et al. ..... 271/262
2005/0228535 A1 10/2005 Simonis et al.
2006/0145412 A1 7/2006 Tagawa et al.

FOREIGN PATENT DOCUMENTS

JP 2004-269241 9/2004

OTHER PUBLICATIONS

Canon Inc., User Manual (functional detail) of scanner "DR-X10C," 2007 with partial English translation URL: http://cweb.canon.jp/manual/dr/pdf/drx10c-usermanual2.pdf (retrieved Dec. 18, 2009).

* cited by examiner

*Primary Examiner* — Kaitlin Joerger
(74) *Attorney, Agent, or Firm* — McDermott Will & Emery LLP

(57) ABSTRACT

An image reading apparatus includes a multifeed detecting mechanism including an ultrasonic sensor, and a control unit. The control unit includes (i) a detecting unit that detects an attached portion on a paper from an output of the ultrasonic sensor for the paper fed, and (ii) a determining unit that ignores, when it is detected as "Occurrence of multifeed" by the multifeed detecting mechanism and if an amount of variation in the output within the attached portion detected by the detecting unit is equal to or more than a first predetermined value, a result of detection as the occurrence of multifeed by the multifeed detecting mechanism, and determines the detection as "No multifeed".

4 Claims, 10 Drawing Sheets

IMAGE READING APPARATUS, MULTIFEED DETERMINING METHOD, AND MULTIFEED DETERMINING PROGRAM

CROSS-REFERENCE TO RELATED APPLICATION

This application is based upon and claims the benefit of priority from Japanese Patent Application No. 2010-112445, filed on May 14, 2010, the entire contents of which are incorporated herein by reference.

BACKGROUND OF THE INVENTION

1. Field of the Invention

The present invention relates to an image reading apparatus (e.g., a scanner, a copier, and a facsimile) that includes a multifeed (MF) detecting function including an ultrasonic (US) sensor, and a multifeed determining method and a multifeed determining program for determining a multifeed based on the result of detection by the multifeed detecting function.

2. Description of the Related Art

In an image reading apparatus (image scanner apparatus), there is widely used an MF detecting function using an US sensor that can detect paper overlapping (e.g., Japanese Patent Application Laid-open No. 2004-269241). However, there is a case where the MF detecting function erroneously detects a medium such as a seal purposely attached to the paper as a multifeed.

As means for avoiding this case, United States Patent Application No. 2005/0228535 discloses a technology for previously setting a length with which multifeed detection is disabled through a panel on a scanner before reading is started, and user manual (functional detail) of scanner "DR-X10C" released in home page of cannon inc. "http://cweb.canon.jp/manual/dr/pdf/drx10c-usermanual2.pdf" discloses a technology for previously setting a starting position and an ending position at which multifeed detection is disabled through a screen on a personal computer connected to a scanner before reading is started.

However, according to the conventional technologies, there is a problem that the length and the position to be disabled have to be previously set, and this causes an operator to carry out complicated and troublesome operations for the setting.

SUMMARY OF THE INVENTION

It is an object of the present invention to at least partially solve the problems in the conventional technology.

An image reading apparatus according to one aspect of the present invention includes a multifeed detecting mechanism including an ultrasonic sensor, and a control unit. The control unit includes (i) a detecting unit that detects an attached portion on a paper from an output of the ultrasonic sensor for the paper fed, and (ii) a determining unit that ignores, when it is detected as an occurrence of multifeed by the multifeed detecting mechanism and if an amount of variation in the output within the attached portion detected by the detecting unit is equal to or more than a first predetermined value, a result of detection as the occurrence of multifeed by the multifeed detecting mechanism, and determines the detection as a no multifeed.

A multifeed determining method according to one aspect of the present invention is implemented by a control unit of an image reading apparatus that includes a multifeed detecting mechanism including an ultrasonic sensor, and the control unit. The multifeed determining method includes (i) a detecting step of detecting an attached portion on a paper from an output of the ultrasonic sensor for the paper fed, and (ii) a determining step of ignoring, when it is detected as an occurrence of multifeed by the multifeed detecting mechanism and if an amount of variation in the output within the attached portion detected at the detecting step is equal to or more than a first predetermined value, a result of detection as the occurrence of multifeed by the multifeed detecting mechanism, and determining the detection as a no multifeed.

A multifeed determining program product according to one aspect of the present invention makes a control unit of an image reading apparatus that includes a multifeed detecting mechanism including an ultrasonic sensor, and the control unit implement a multifeed determining method. The multifeed determining method includes (i) a detecting step of detecting an attached portion on a paper from an output of the ultrasonic sensor for the paper fed, and (ii) a determining step of ignoring, when it is detected as an occurrence of multifeed by the multifeed detecting mechanism and if an amount of variation in the output within the attached portion detected at the detecting step is equal to or more than a first predetermined value, a result of detection as the occurrence of multifeed by the multifeed detecting mechanism, and determining the detection as a no multifeed.

A recording medium according to one aspect of the present invention includes the multifeed determining program product described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of an image reading apparatus, a multifeed determining method, and a multifeed determining program according to the present invention will be explained in detail below with reference to the accompanying drawings. It should be noted that the present invention is not limited by the embodiments.

1. Overview of Present Embodiment

Figure 1A:
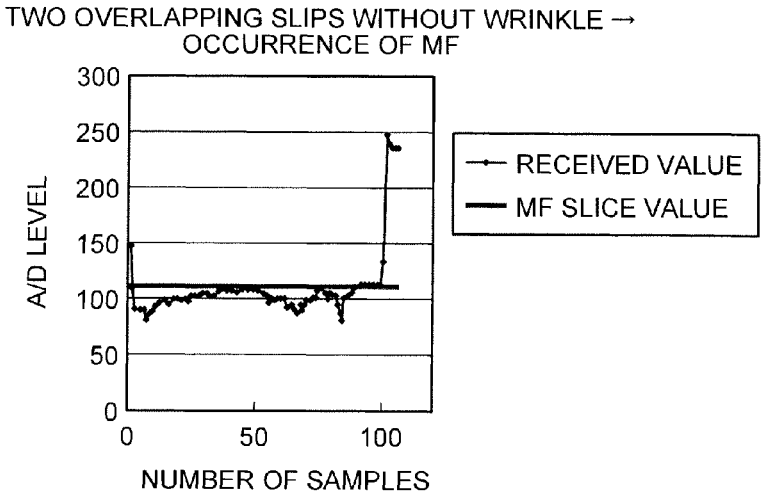
FIGS. 1A to 1C are diagrams representing reference examples of a case of detecting a multifeed caused by an attachment.
Figure 1B:
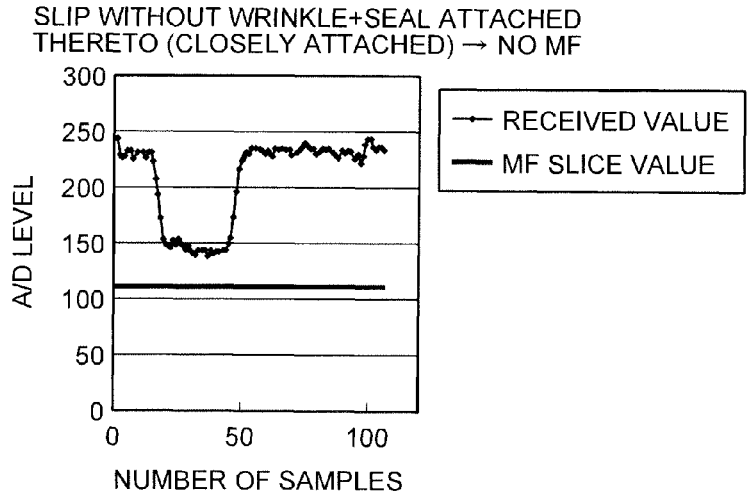
Figure 1C:
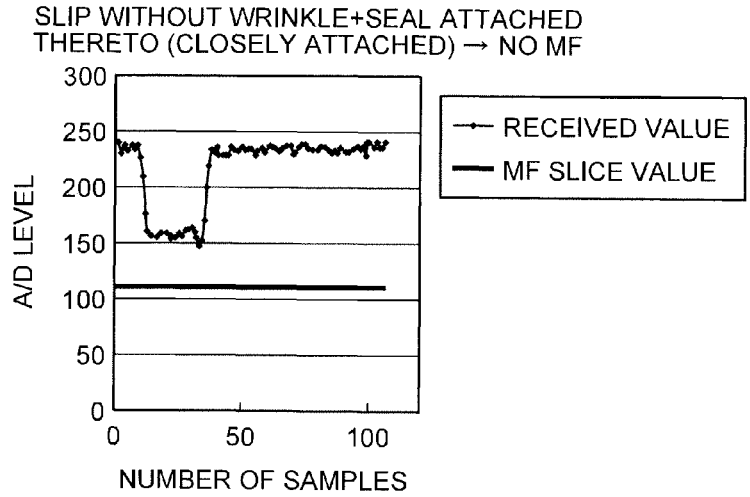
Figure 2A:
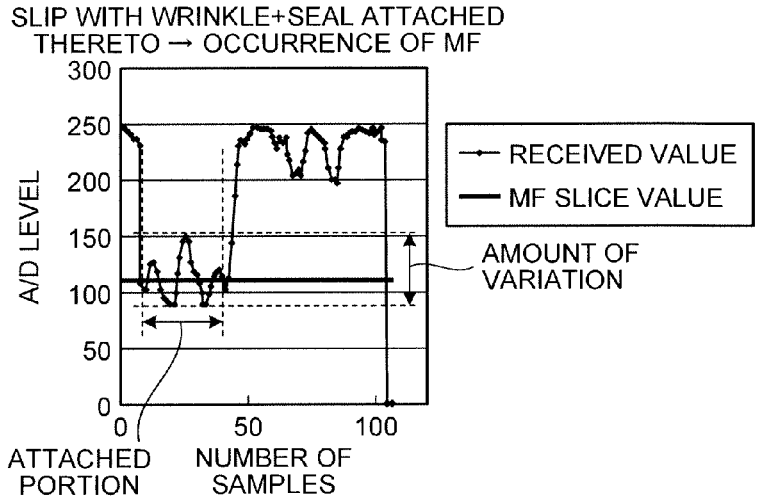
FIGS. 2A to 2C are diagrams representing one examples of a case of an attachment which is detected as a multifeed.
Figure 2B:
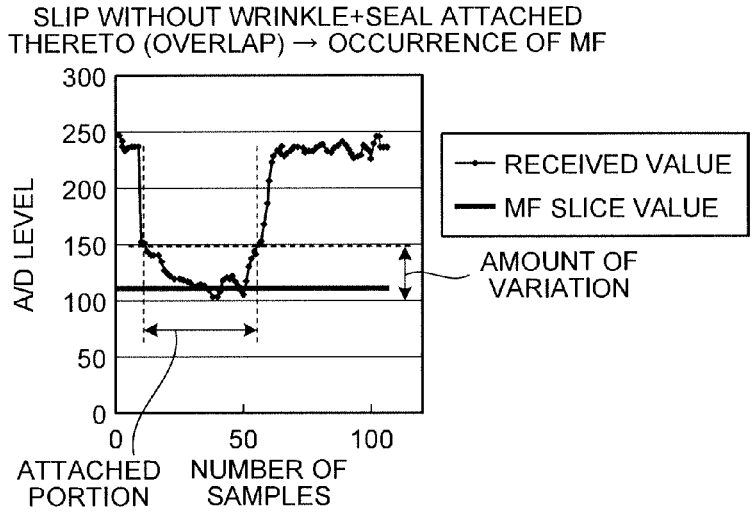
Figure 2C:
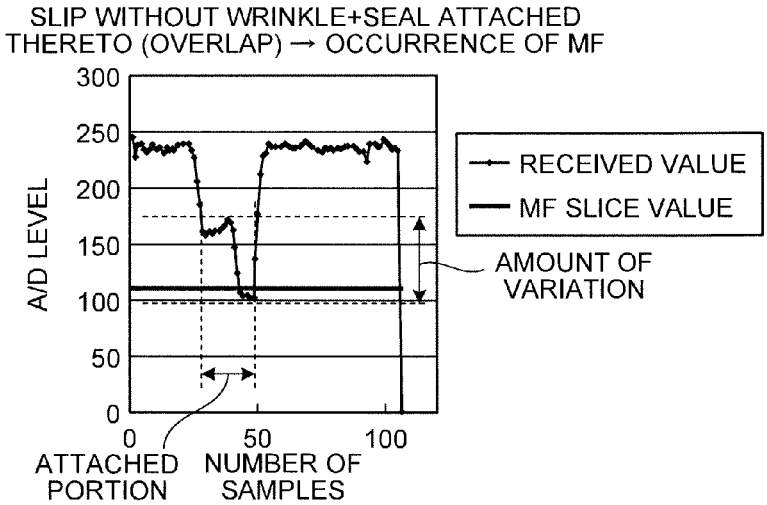

Here, the overview of the present embodiment will be explained with reference to FIGS. 1A to 1C and FIGS. 2A to 2C. FIGS. 1A to 1C are diagrams representing reference examples of a case of detecting a multifeed caused by an attachment. FIGS. 2A to 2C are diagrams representing one examples of a case of an attachment which is detected as a multifeed.

Generally, an image reading apparatus (e.g., a scanner, a copier, and a facsimile) that includes a multifeed (MF) detecting mechanism using an ultrasonic (US) sensor compares an output (received value (A/D level)) of the US sensor with a preset threshold (MF slice value), and determines whether MF occurs. Thus, in the case shown in FIG. 1A in which two delivery slips without wrinkle are read in their overlapped state, the output of the US sensor is below the MF slice value, and as a result, it is detected as "Occurrence of MF". Furthermore, in the case shown in FIG. 1B in which a delivery slip without wrinkle and with a closely attached seal is read and in the case shown in FIG. 1C in which a delivery slip without wrinkle and with a closely attached mending tape is read, because there is no air layer between the delivery slip and the seal, the output of the US sensor is not below the MF slice value, and as a result, it is detected as "No MF".

However, in the case shown in FIG. 2A in which a delivery slip with wrinkle and with an attached seal is read, in the case shown in FIG. 2B in which a delivery slip without wrinkle and with an attached seal in a slight overlapping manner is read, and in the case shown in FIG. 2C in which a delivery slip without wrinkle and with an attached mending tape so as to form an air layer therebetween is read, there is an air layer between the seal or the mending tape and the delivery slip. Therefore, the outputs of the US sensor are below the MF slice value, and as a result, these cases are detected as "Occurrence of MF". In this manner, there is the case in which it is detected as MF caused by a medium such as a purposely attached seal.

In the present embodiment, therefore, as shown in FIGS. 2A to 2C, characteristics of a variation in multi-valued output of the US sensor (specifically, an amount of variation in output) are focused on, and there is developed the following "attached-portion-MF ignore mode" that ignores MF which is caused by the attached portion and is detected by the MF detecting mechanism.

Specifically, a large variation from a high value to a low value of outputs of the US sensor and a large variation from a low value to a high value thereof are sequentially captured. When the amount of variation in an output between two portions where there is the large variation is a predetermined value or more, then an area between the two portions is recognized as being equivalent to the attached portion, and this area is prevented from being detected as MF.

More specifically, the following processes from (1) to (5) are executed.

(1) While outputs (current value) of the US sensor are collected, the maximum value and the minimum value thereof are held.

(2) An area where the minimum value largely varies from the high value to the low value is detected as an upper end of the attached portion.

(3) While outputs (current value) of the US sensor are collected from the area where the upper end of the attached portion is detected and the subsequent areas, the maximum value and the minimum value thereof are separately held.

(4) An area where the output (current value) of the US sensor largely varies from the low value and is returned to the high value near the maximum value which is held as explained in (1) is detected as a lower end of the attached portion.

(5) When an amount of variation (specifically, the difference between the maximum value and the minimum value separately held as explained in (3)) in the output of the US sensor over the attached portion from the upper end of the attached portion to the lower end thereof is a predetermined value or more, it is recognized as "attachment", and MF detected by the MF detecting mechanism is ignored.

In this manner, the image reading apparatus is provided with the "attached-portion-MF ignore mode", and this enables to automatically ignore MF detection in the attached portion without the complicated operation.

2. Configuration of Present Embodiment

Here, the configuration of an image reading apparatus 100 according to the present embodiment will be explained in detail with reference to FIG. 3 to FIG. 5.

2-1. Overview of Configuration

First, the overview of the configuration of the image reading apparatus 100 according to the present embodiment will be explained with reference to FIG. 3. FIG. 3 is a diagram representing one example of the configuration of the image reading apparatus according to the present embodiment.

The image reading apparatus 100 includes a multifeed processing unit 102, a multifeed detecting unit (mechanism) 112, an image reading unit (mechanism) 114 in a functionally conceptual manner, and these units are communicably connected to each other through an arbitrary communication path.

The multifeed detecting unit 112 is a mechanism for detecting a multifeed of a fed paper, and includes, for example, an US sensor (hardware) for detecting overlap of papers and the thickness thereof using ultrasonic waves, and a processing unit (software) for detecting whether MF occurs from the output of the US sensor. A specific example of the configuration of the multifeed detecting unit 112 will be explained in detail later in "2-2. Specific Example of Configuration". The image reading unit 114 is a mechanism for reading a fed paper by a paper sensor and generating an image of the paper.

Figure 3:
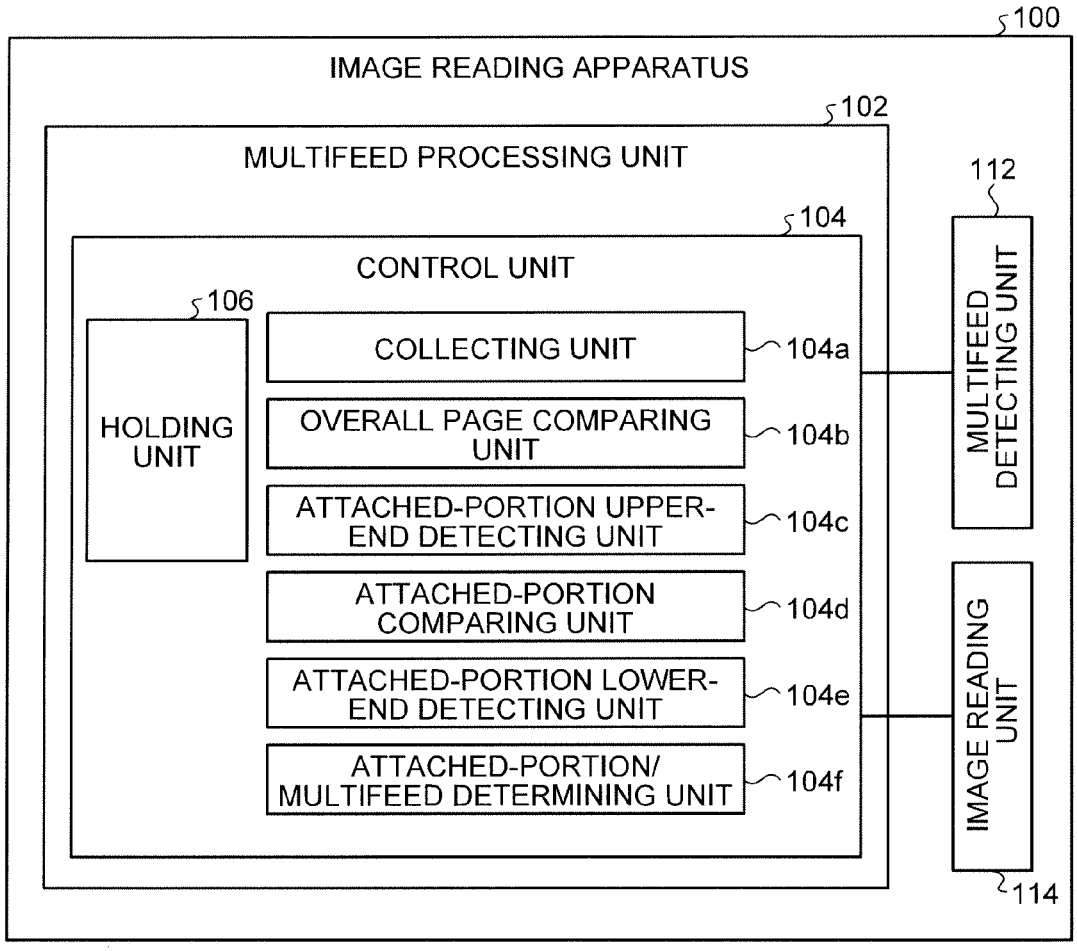
FIG. 3 is a diagram representing one example of a configuration of an image reading apparatus according to a present embodiment.

The multifeed processing unit 102, as shown in FIG. 3, includes a control unit 104 in a functionally conceptual manner. The control unit 104 includes a CPU (Central Processing Unit) for controlling the image reading apparatus 100 (particularly, the multifeed processing unit 102), and the like. The control unit 104 includes an internal memory for storing therein a control program such as OS (Operating System) and programs defining various processing procedures or the like and also storing therein required data, and performs information processes for executing various processes based on the programs. The control unit 104 includes a collecting unit 104*a*, an overall page comparing unit 104*b*, an attached-portion upper-end detecting unit 104*c*, an attached-portion comparing unit 104*d*, an attached-portion lower-end detecting unit 104*e*, an attached-portion/multifeed determining unit 104*f*, and a holding unit 106 in a functionally conceptual manner.

The holding unit 106 is used to hold calculation and execution statuses, and includes an overall-page maximum value register, an overall-page minimum value register, an attached-portion maximum value register, an attached-portion minimum value register, an attached-portion upper-end detection flag, and a flag indicating number of recognized attached portions, which will be explained in detail later in "3. Process of Present Embodiment".

The collecting unit 104*a* collects a current value of a US-sensor output from the US sensor in the multifeed detecting unit 112.

The overall page comparing unit 104*b* compares the current value of the output collected by the collecting unit 104*a* with the maximum value held in the overall-page maximum value register and with the minimum value held in the overall-page minimum value register. When the current value is more than the maximum value, then the overall page comparing unit 104*b* stores the current value in the overall-page maximum value register to update the overall-page maximum value register. When the current value is less than the minimum value, then the overall page comparing unit 104*b* stores the current value in the overall-page minimum value register to update the overall-page minimum value register.

The attached-portion upper-end detecting unit 104*c* compares the maximum value held in the overall-page maximum value register with the minimum value held in the overall-page minimum value register, and detects an upper end of the attached portion from the result of comparison. When a difference between the maximum value held in the overall-page maximum value register and the minimum value held in the overall-page minimum value register is a predetermined value (which corresponds to a second predetermined value in the present invention, for example, 65% of the maximum value) or more, the attached-portion upper-end detecting unit 104*c* recognizes that the upper end of the attached portion has been detected.

After the upper end of the attached portion is detected, the attached-portion comparing unit 104*d* compares the current value of the output of the US sensor collected by the collecting unit 104*a* with the minimum value held in the overall-page minimum value register, with the maximum value held in the attached-portion maximum value register, and with the minimum value held in the attached-portion minimum value register. When the current value of the output is more than the maximum value held in the attached-portion maximum value register, then the attached-portion comparing unit 104*d* stores the current value in the attached-portion maximum value register to update the attached-portion maximum value register. When the current value of the output is less than the minimum value held in the overall-page minimum value register, then the attached-portion comparing unit 104*d* stores the current value in the overall-page minimum value register to update the overall-page minimum value register. In addition, when the current value of the output is less than the minimum value held in the attached-portion minimum value register, then the attached-portion comparing unit 104*d* stores the current value in the attached-portion minimum value register to update the attached-portion minimum value register.

After the upper end of the attached portion is detected, the attached-portion lower-end detecting unit 104*e* compares the current value of the output of the US sensor collected by the collecting unit 104*a* with the maximum value held in the overall-page maximum value register, and detects a lower end of the attached portion from the result of comparison. When a difference between the maximum value held in the overall-page maximum value register and the current value of the output of the US sensor is a predetermined value (which corresponds to a third predetermined value in the present invention, for example, 35% of the maximum value) or less, the attached-portion lower-end detecting unit 104*e* recognizes that the lower end of the attached portion has been detected.

When the result of MF detection performed by the multifeed detecting unit 112 is "No MF", the attached-portion/multifeed determining unit 104*f* determines the case as "No MF". When the result of MF detection performed by the multifeed detecting unit 112 is "Occurrence of MF" and if no attached portion is detected, then the attached-portion/multifeed determining unit 104*f* determines the case as "Occurrence of MF". When the result of MF detection performed by the multifeed detecting unit 112 is "Occurrence of MF" and if an attached portion is detected and a difference between the maximum value and the minimum value of the attached portion is a predetermined value (which corresponds to a first predetermined value in the present invention, for example, 40% of the maximum value) or more, then the attached-portion/multifeed determining unit 104*f* recognizes it as "attachment", ignores the result of MF detection by the multifeed detecting unit 112, and determines the case as "No MF". When a plurality of attached portions is detected and if the attached portions satisfy a condition that "a difference between the maximum value and the minimum value is a predetermined value (e.g., 40% of the maximum value) or more", then the attached-portion/multifeed determining unit 104*f* ignores the result of MF detection by the multifeed detecting unit 112, and determines the case as "No MF".

2-2. Specific Example of Configuration

Next, a specific example of the configuration of the image reading apparatus 100 configured in the above manner will be explained in detail with reference to FIG. 4 and FIG. 5. A specific configuration of the image reading apparatus which is a scanner is explained herein, however, the image reading apparatus is not limited to the scanner, and thus can be applied to a copier, a facsimile, and the like.

Figure 4:
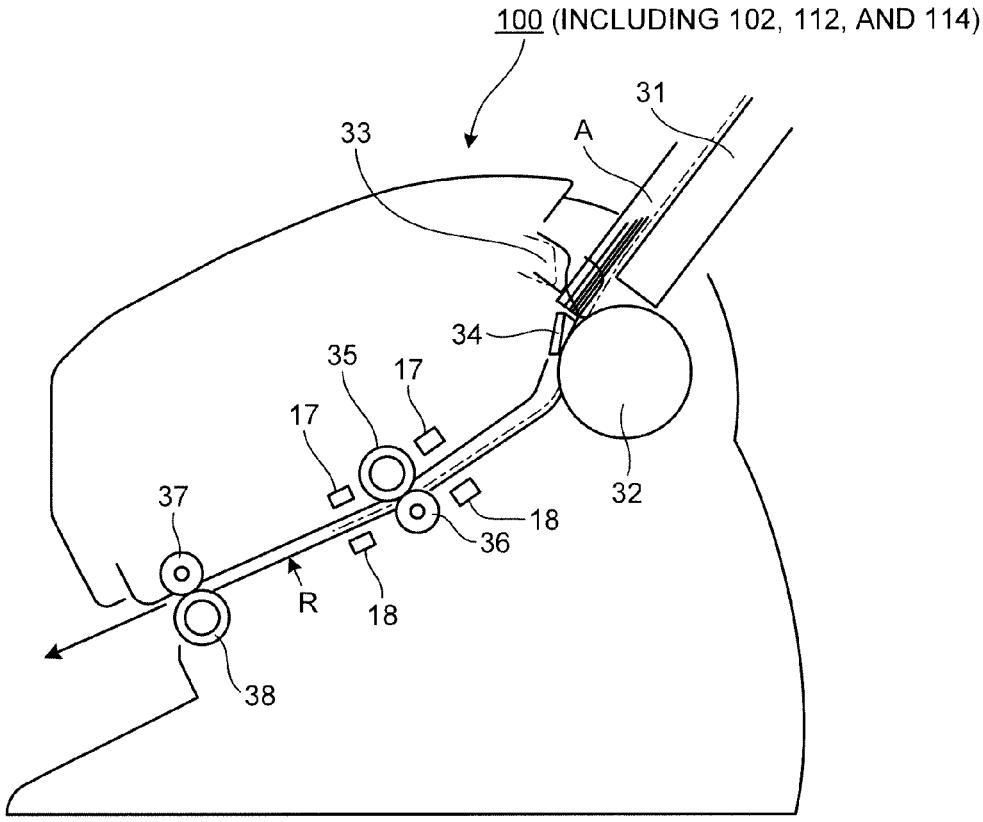
FIG. 4 is a schematic representing a configuration of a scanner being a specific example of the image reading apparatus according to the present embodiment.

FIG. 4 is a schematic representing an overview of a cross section of a scanner as the image reading apparatus 100 (hereinafter, sometimes described as "scanner 100"), and this figure shows an overview of the configuration of the scanner to which the multifeed detecting unit 112 and the image reading unit 114 are applied.

As shown in FIG. 4, the scanner 100 includes a paper mounting table (shooter) 31, a pick roller 32, a pick arm 33, a separation pad 34, feed rollers 35 and 36, and ejection rollers 37 and 38. The scanner 100 also includes a transmission-side ultrasonic sensor 17 and a reception-side ultrasonic sensor 18 of an ultrasonic detector, which is explained later, corresponding to the multifeed detecting unit 112. In FIG. 4, a dashed two-dotted line indicates a feed path of a paper A, and an arrow R indicates a reading position of the paper A.

Papers A placed on the paper mounting table (shooter) 31 are picked by the pick roller 32 in a state where the papers A are applied with an appropriate pressing force by the pick arm 33. At this time, the papers A are sequentially separated from their lower side sheet by sheet by the pick roller 32 and the separation pad 34. The picked paper A is further fed to the feed rollers 35 and 36 by the pick roller 32, is fed to a reading position by the feed rollers 35 and 36, is read by the image reading unit 114 at the reading position, and is ejected by the ejection rollers 37 and 38. During feeding of the paper A along the feed path, a plurality of sheets (usually two sheets) or multiply fed papers A which are not separated into one sheet each even by the separation pad 34 are detected by the transmission-side ultrasonic sensor 17 and the reception-side ultrasonic sensor 18. Therefore, as shown in FIG. 4, the transmission-side ultrasonic sensor 17 and the reception-side ultrasonic sensor 18 are disposed on the upstream side of the reading position where the paper is read by the image reading unit 114 in the feed path. Particularly, the sensors are disposed on the downstream side or the upstream side of the feed rollers 35 and 36.

Figure 5:
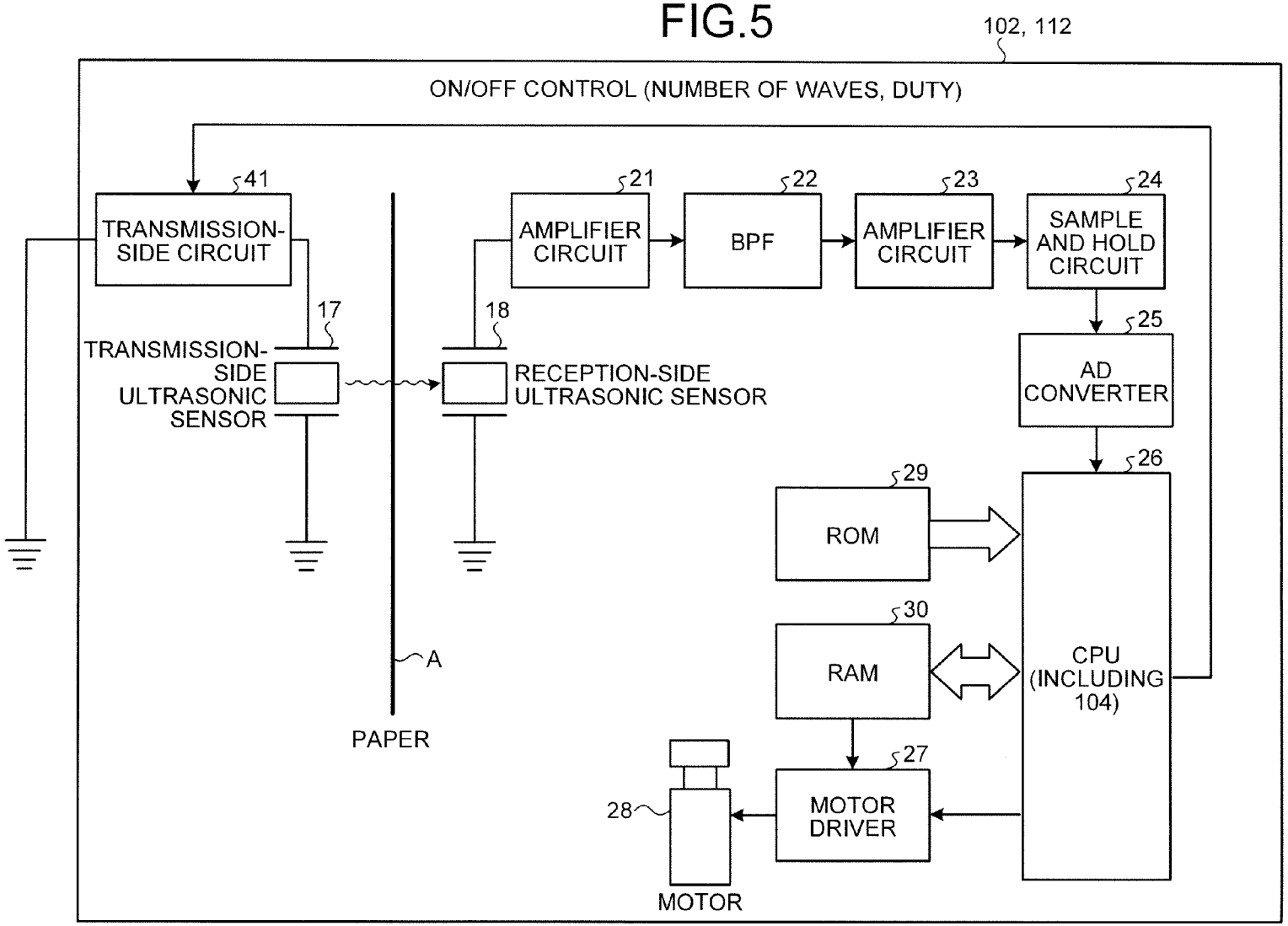
FIG. 5 is a diagram representing one example of a configuration of a multifeed detecting unit included in the scanner shown in FIG. 4.

FIG. 5 is a diagram representing one example of a specific configuration of the multifeed processing unit 102 and the multifeed detecting unit 112. In FIG. 5, the ultrasonic detector corresponding to the multifeed detecting unit 112 detects feeding of a plurality of papers A using ultrasonic waves. The ultrasonic detector includes the transmission-side ultrasonic sensor 17, a drive circuit thereof (transmission-side circuit, hereinafter the same) 41, the reception-side ultrasonic sensor 18, a setting unit (26) for setting a threshold (MF slice value) used to detect feeding of a plurality of papers A (multifeed), and a detector (26) for detecting the feeding of the plurality of papers A.

The transmission-side ultrasonic sensor 17 emits an ultrasonic wave. The drive circuit 41 supplies a drive signal for driving the transmission-side ultrasonic sensor 17 thereto. The drive circuit 41 is configured with a circuit (which can ON/OFF control) that oscillates at a frequency near a resonant frequency of the transmission-side ultrasonic sensor 17. The reception-side ultrasonic sensor 18 is disposed so as to face the transmission-side ultrasonic sensor 17 across a paper feed path, and receives the ultrasonic wave. The setting unit sets a threshold (MF slice value) used to detect the feeding of the plurality of papers A using an output of the reception-side ultrasonic sensor 18 as a reference value when an output of the transmission-side ultrasonic sensor 17 is stopped by the drive circuit 41. The detector compares the output of the reception-side ultrasonic sensor 18 with the threshold (MF slice value), and detects the feeding of the plurality of papers A.

The ultrasonic detector further includes an amplifier circuit 21 (at a first stage), a BPF (Band Pass Filter) 22, an amplifier circuit 23 (at a second stage), a sample and hold (S&H) circuit 24, an AD (Analog to Digital) converter 25, CPU 26, a motor driver 27, a motor 28, ROM (Read Only Memory) 29, and RAM (Random Access Memory) 30. These components constitute a reception-side circuit. More specifically, the reception-side ultrasonic sensor 18 outputs an electrical signal according to the ultrasonic wave received from the transmission-side ultrasonic sensor 17, the amplifier circuit 21 amplifies the electrical signal, the BPF removes noise therefrom, and, thereafter, the amplifier circuit 23 amplifies the signal after the noise is removed. Then, after the sample and hold circuit 24 samples and holds (SH) a peak value of the signal, the AD converter 25 converts the peak value (analog signal) into a digital value (digital signal). The AD converter 25 inputs the digital signal (input signal) to the CPU 26 (the setting unit and the detector therein), where it is analyzed. More specifically, the setting unit and the detector implemented by a setting and detection processing program (and hardware) on the CPU 26 analyze the input signal. The setting and detection processing program is stored in, for example, the ROM 29 and/or the RAM 30. When a multifeed is detected, the CPU 26 (or detector) transmits the drive signal to the motor driver 27, and causes the motor 28 to drive so as to stop feeding of (a plurality of) papers A. The CPU 26 includes units (the collecting unit 104*a* to the attached-portion/multifeed determining unit 104*f*, and the holding unit 106) of the control unit 104 in the multifeed processing unit 102 in addition to the setting unit and the detector in the multifeed detecting unit 112. The control unit 104 of the multifeed processing unit 102 acquires the detection result of the feeding of a plurality of papers by the detector (MF detection result containing "Occurrence of MF" or "No MF").

The ultrasonic detector includes the transmission-side circuit (drive circuit) 41. The transmission-side circuit 41 is configured from a drive IC, a resistance/frequency-controlled oscillator (OSC), and a variable resistor. The drive IC is a drive circuit for supplying a drive signal to drive the transmission-side ultrasonic sensor 17 thereto. This causes the transmission-side ultrasonic sensor 17 to emit an ultrasonic wave. The reception-side ultrasonic sensor 18 receives the ultrasonic wave, and outputs a detection signal according to the intensity of the received ultrasonic wave. For example, when the paper A is not present between the transmission-side ultrasonic sensor 17 and the reception-side ultrasonic sensor 18, the reception-side ultrasonic sensor 18 detects a signal with a certain level (ordinary level), and detects a signal with a level (normal level) less than the ordinary level but more than a predetermined threshold when a sheet of paper A is present. When two sheets (or more) of paper A are present, the reception-side ultrasonic sensor 18 detects a signal with a level (abnormal level) less than the ordinary level and the threshold. For example, before feeding of the paper A, the drive IC is controlled so that the reception-side ultrasonic sensor 18 detects the signal with the ordinary level (in actual cases, the signal with a level equal to or more than the ordinary level). More specifically, the drive IC is controlled so that the drive frequency of the drive signal coincides with the resonant frequency of the transmission-side ultrasonic sensor 17 based on the ultrasonic wave received by the reception-side ultrasonic sensor 18 without using the variable resistor.

The setting unit sets (generates) a threshold (MF slice value) used to detect feeding of a plurality of papers A using an output of the reception-side ultrasonic sensor 18 as a reference value when an output of the transmission-side ultrasonic sensor 17 is stopped by the drive circuit 41. The threshold is determined by adding a fixed value (correction value) to the output (average value of input signals from the reception-side ultrasonic sensor 18) of the reception-side ultrasonic sensor 18 when an output of the transmission-side ultrasonic sensor 17 is stopped. More specifically, the CPU 26 (sensor control unit therein) transmits a control signal to the transmission-side circuit 41 and causes the oscillation of the transmission-side circuit 41 to stop. The CPU 26 (sensor control unit therein) applies a predetermined bias voltage to the amplifier circuit 23 (computation amplifier therein). In this state, the CPU 26 (generation unit therein) repeatedly receives the input signals, tens of times, for example, 32 times, from the reception-side ultrasonic sensor 18 through the AD converter 25, and calculates an average value thereof to set the value as a reference value. More specifically, the signals at 32 points within, for example, one raster are measured. The CPU 26 (generation unit therein) corrects to add the correction value to the reference value and generates the threshold, and stores the threshold in the CPU 26 (register therein). Here, the correction value is determined empirically for each device to be installed allowing for the influence of noise or the like. It should be noted that the correction value may be determined beforehand and that the correction value may be determined, each time it is required, as a variable value for each device for allowing for influence of variation in sensitivity/sound pressure of the ultrasonic sensor, variation in fixture, surroundings, and adhesion of paper dust or the like.

The detector compares the output of the reception-side ultrasonic sensor 18 with the threshold (MF slice value), and detects feeding of a plurality of papers A. The CPU 26 (sensor control unit therein) transmits a control signal to the transmission-side circuit 41 and the like to cause the transmission-side circuit 41 to oscillate. Moreover, the CPU 26 (sensor control unit therein) applies a predetermined bias voltage to the amplifier circuit 23 (computation amplifier therein). In this state, the CPU 26 (comparator therein) repeatedly receives the input signals (digital values), tens of times, for example, 32 times, from the reception-side ultrasonic sensor 18 through the AD converter 25, and holds the received signals. At this time, the oscillation (transmission-side drive pulses) of the transmission-side circuit 41 is stopped and the signals at a plurality of predetermined positions, for example, at 32 points are measured. The measuring position is set to once in, for example, each raster or once in a plurality of rasters. When an output waveform of the reception-side ultrasonic sensor 18 is getting larger to become a maximum value, the maximum value is sampled and held. Next, the CPU 26 (sensor control unit or comparator therein) sets a timer for SH interrupt, and determines whether an interrupt occurs. The SH interrupt is set so as to occur 32 times when, for example, 32 input signals are to be obtained as explained above. In other words, the SH interrupt triggers continuous outputs of drive pulses in the transmission side. For example, 32 times of SH interrupts occur in once in each raster with the passage of a predetermined time. When the interrupt does not occur, the determination of occurrence of the interrupt is repeated. When an interrupt occurs, an average value of 32 values previously received and held, for example, a moving average value is calculated, and this value is determined as a value of an input signal used to detect the multifeed (MF). Thereafter, the CPU 26 (comparator therein) compares the value of the input signal with the threshold of the register. When the value of the input signal is equal to or more than the threshold, the CPU 26 (comparator therein) determines that the result is normal paper feeding, while when the value of the input signal is less than the threshold, the CPU 26 (comparator therein) determines whether the number of times in this case is predetermined times, for example, ten times or more. When it is determined that the number of times is 10 times or more, the CPU 26 (comparator therein) determines that a multifeed occurs, and outputs an error signal. When it is determined that the number of times is not 10 times or more, the following processes performed after the timer is set are repeated. The error signal is then input to the control unit 104 of the multifeed processing unit 102 included in the CPU 26.

3. Process of Present Embodiment

Figure 6:
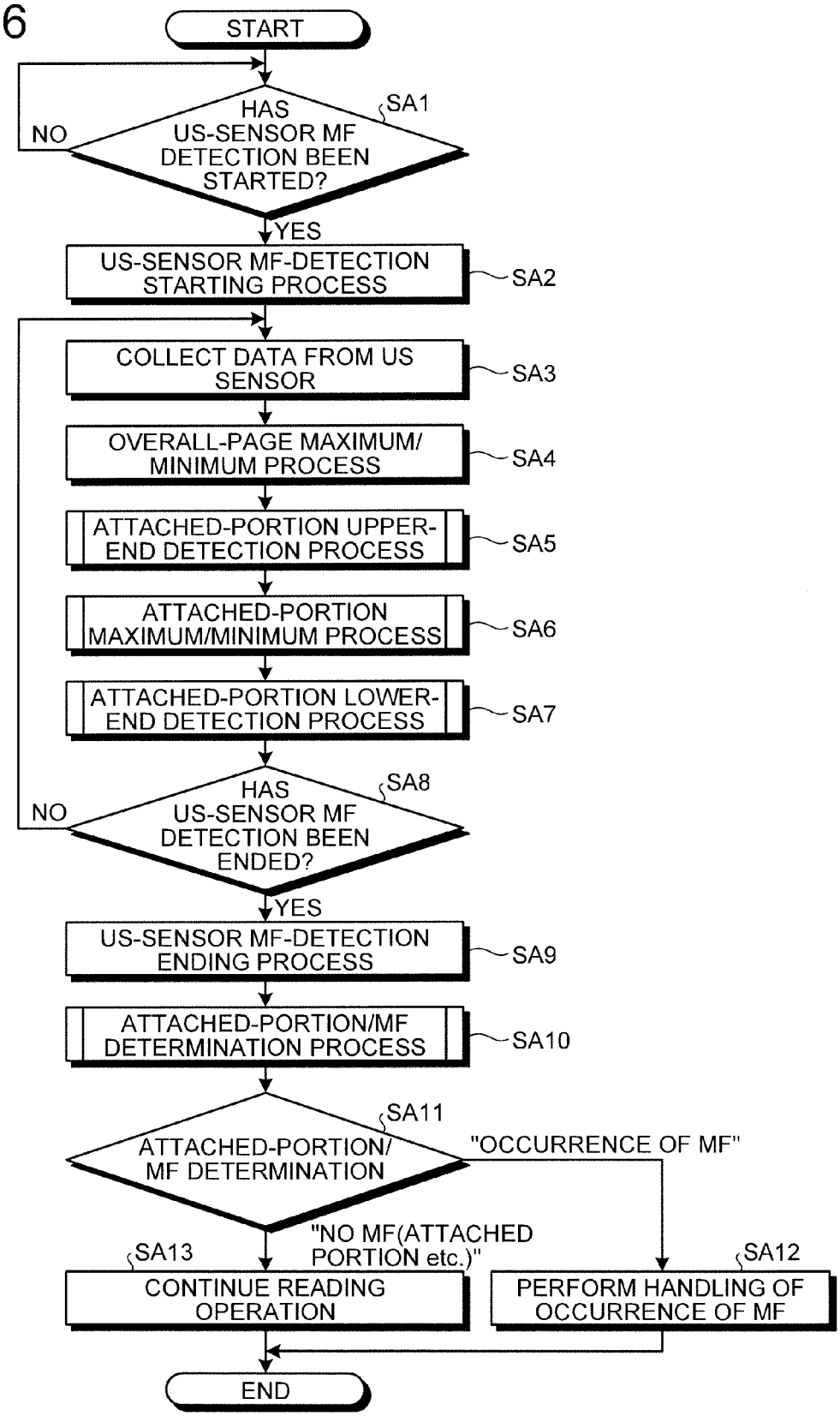
FIG. 6 is a flowchart representing one example of a US-sensor MF detection process according to the present embodiment.

Here, one example of a US-sensor MF detection process or the like executed in the image reading apparatus 100 configured in the above manner will be explained with reference to FIG. 6 to FIG. 10. FIG. 6 is a flowchart representing one example of the US-sensor MF detection process according to the present embodiment.

First, when a leading edge of a fed paper (page) reaches the US sensor of the multifeed detecting unit 112 and the multifeed detecting unit 112 starts MF detection (Yes at Step SA1), the control unit 104 clears the following registers and flags in the holding unit 106 (Step SA2: US-sensor MF-detection starting process).

Overall-page maximum value register for holding the maximum value of US-sensor outputs in an overall page Overall-page minimum value register for holding the minimum value of the US-sensor outputs in the overall page Attached-portion maximum value register for holding the maximum value of the US-sensor outputs in an attached portion Attached-portion minimum value register for holding the minimum value of the US-sensor outputs in the attached portion Attached-portion upper-end detection flag for managing a detection state (detected or not detected) of an upper end of the attached portion Flag indicating number of recognized attached portions for managing the number of recognized attached portions Next, the collecting unit 104*a* synchronizes pulses of a feeding motor and collects a current value of a US-sensor output from the US sensor (Step SA3).

Next, the overall page comparing unit 104*b* compares the current value of the output collected at Step SA3 with the maximum value held in the overall-page maximum value register and with the minimum value held in the overall-page minimum value register. When the current value is more than the maximum value, then the overall page comparing unit 104*b* stores the current value in the overall-page maximum value register to update the overall-page maximum value register. When the current value is less than the minimum value, then the overall page comparing unit 104*b* stores the current value in the overall-page minimum value register to update the overall-page minimum value register (Step SA4: overall-page maximum/minimum process).

Next, the attached-portion upper-end detecting unit 104*c* compares the maximum value held in the overall-page maximum value register with the minimum value held in the overall-page minimum value register, and detects an upper end of the attached portion from the result of comparison (Step SA5: attached-portion upper-end detection process).

Figure 7:
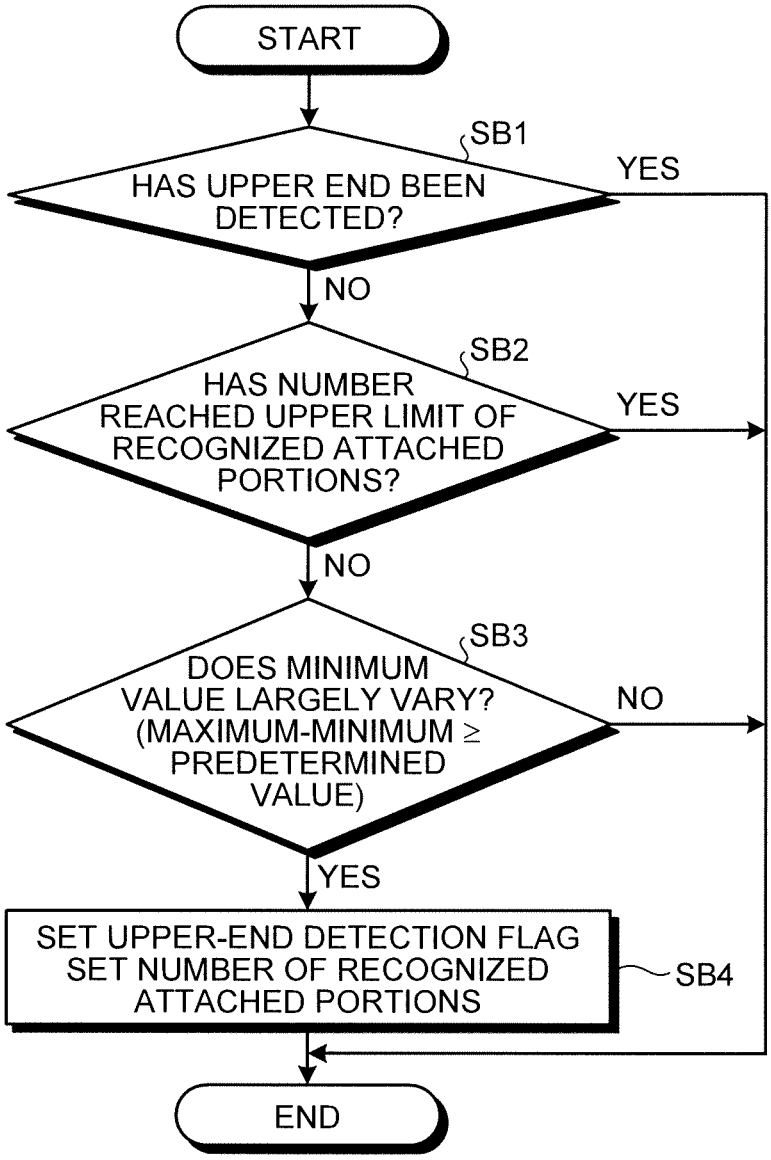
FIG. 7 is a flowchart representing one example of an attached-portion upper-end detection process according to the present embodiment.

Here, one example of the attached-portion upper-end detection process will be explained with reference to FIG. 7. FIG. 7 is a flowchart representing one example of the attached-portion upper-end detection process according to the present embodiment.

First, the attached-portion upper-end detecting unit 104*c* checks whether the upper end of the attached portion has been detected using the value held in the attached-portion upper-end detection flag.

Next, when verifying that the upper end has not been detected (No at Step SB1), the attached-portion upper-end detecting unit 104*c* further checks whether the number of currently recognized attached portions has reached a predetermined upper limit of recognized attached portions using the value held in the flag indicating number of recognized attached portions.

Next, the attached-portion upper-end detecting unit 104*c*, when verifying that it has not reached the upper limit of recognized attached portions (No at Step SB2), checks whether a difference between the maximum value held in the overall-page maximum value register and the minimum value held in the overall-page minimum value register is a predetermined value (e.g., 65% of the maximum value) or more.

Then, when verifying that it is the predetermined value or more (Yes at Step SB3), the attached-portion upper-end detecting unit 104*c* recognizes that the upper end of the attached portion has been detected, and sets the attached-portion upper-end detection flag and also increments the flag indicating number of recognized attached portions in order to store the number of recognized attached portions (Step SB4).

The explanation on the attached-portion upper-end detection process is ended herein.

Referring back to FIG. 6, after the upper end of the attached portion is detected, the attached-portion comparing unit 104*d* compares the current value of an output of the US sensor collected at Step SA3 with the minimum value held in the overall-page minimum value register, with the maximum value held in the attached-portion maximum value register, and with the minimum value held in the attached-portion minimum value register. The attached-portion comparing unit 104*d* updates the overall-page minimum value register, the attached-portion maximum value register, and the attached-portion minimum value register according to the results of comparison (Step SA6: attached-portion maximum/minimum process).

Figure 8:
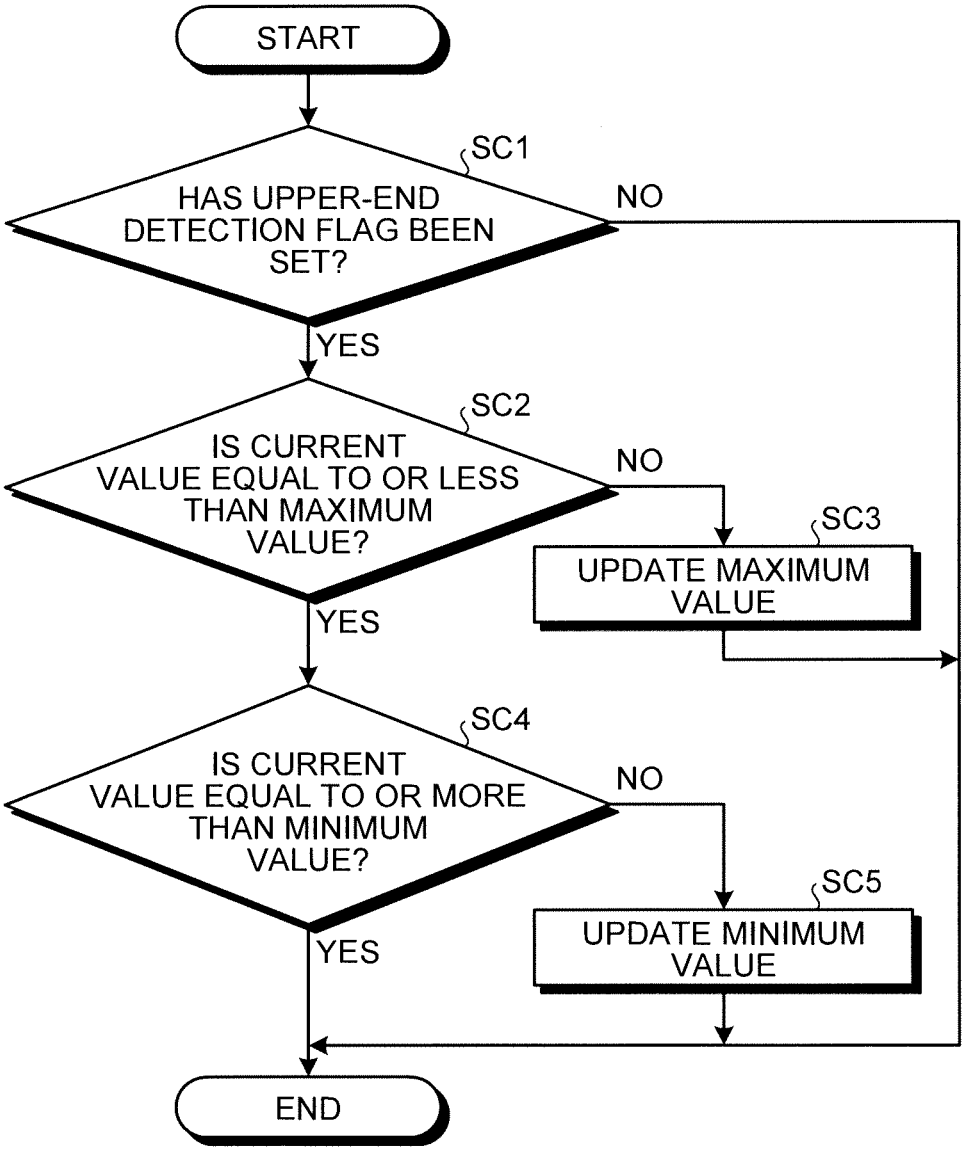
FIG. 8 is a flowchart representing one example of an attached-portion maximum/minimum process according to the present embodiment.

Here, one example of the attached-portion maximum/minimum process will be explained with reference to FIG. 8. FIG. 8 is a flowchart representing one example of the attached-portion maximum/minimum process according to the present embodiment.

First, the attached-portion comparing unit 104*d* checks whether the upper end of the attached portion has been detected using the value held in the attached-portion upper-end detection flag (Step SC1).

Next, when verifying that the upper end has been detected (Yes at Step SC2), the attached-portion comparing unit 104*d* checks whether the current value of an output of the US sensor is equal to or less than the maximum value held in the attached-portion maximum value register.

Next, when verifying that it is not equal to or less than the maximum value (No at Step SC2), the attached-portion comparing unit 104*d* stores the current value of the output in the attached-portion maximum value register and updates the attached-portion maximum value register (Step SC3).

When verifying that it is equal to or less than the maximum value (Yes at Step SC2), the attached-portion comparing unit 104*d* further checks whether the current value of the output is equal to or more than the minimum value held in the overall-page minimum value register and checks whether the current value of the output is equal to or more than the minimum value held in the attached-portion minimum value register.

When verifying that it is not equal to or more than the minimum value held in the overall-page minimum value register (No at Step SC4), the attached-portion comparing unit 104*d* stores the current value of the output in the overall-page minimum value register and updates the overall-page minimum value register (Step SC5). When verifying that it is not equal to or more than the minimum value held in the attached-portion minimum value register (No at Step SC4), the attached-portion comparing unit 104*d* stores the current value of the output in the attached-portion minimum value register and updates the attached-portion minimum value register (Step SC5).

The explanation on the attached-portion maximum/minimum process is ended herein.

Referring back to FIG. 6, after the upper end of the attached portion is detected, the attached-portion lower-end detecting unit 104*e* compares the current value of an output of the US sensor collected at Step SA3 with the maximum value held in the overall-page minimum value register, and detects the lower end of the attached portion from the result of comparison (Step SA7: attached-portion lower-end detection process).

Figure 9:
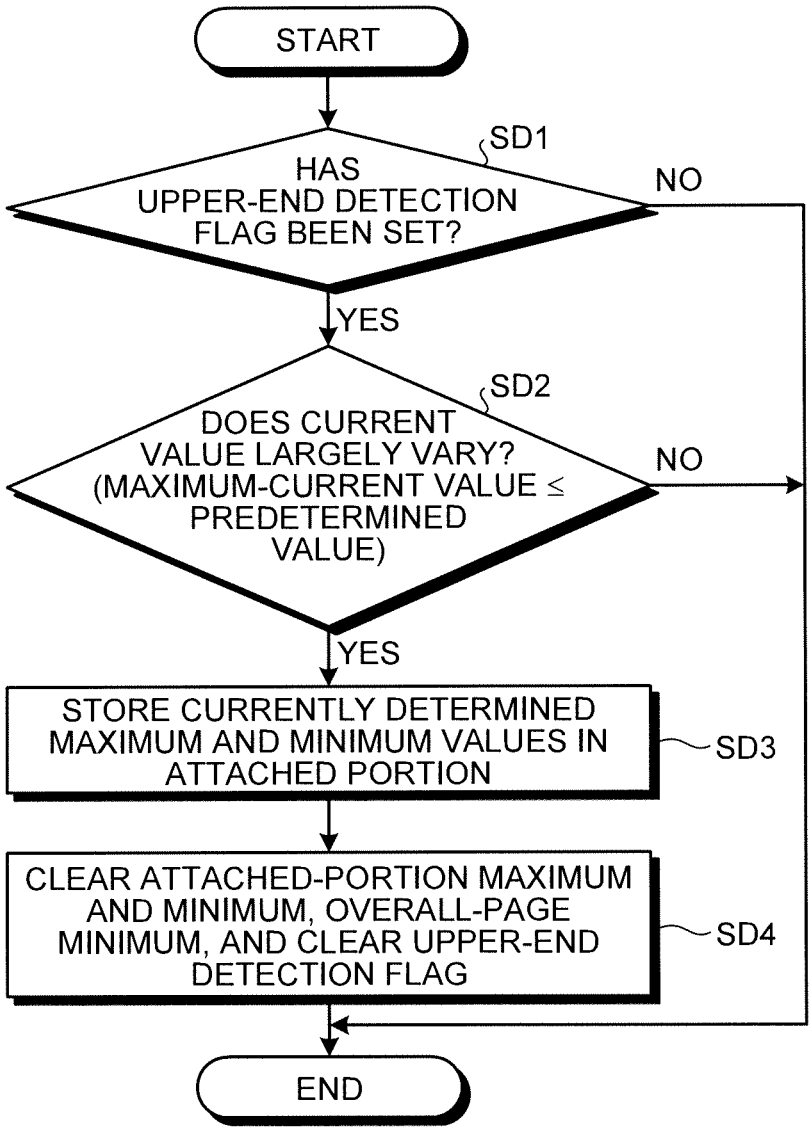
FIG. 9 is a flowchart representing one example of an attached-portion lower-end detection process according to the present embodiment.

Here, one example of the attached-portion lower-end detection process will be explained with reference to FIG. 9. FIG. 9 is a flowchart representing one example of the attached-portion lower-end detection process according to the present embodiment.

First, the attached-portion lower-end detecting unit 104*e* checks whether the upper end of the attached portion has been detected using the value held in the attached-portion upper-end detection flag.

Next, when verifying that the upper end has been detected (Yes at Step SD1), the attached-portion lower-end detecting unit 104*e* checks whether a difference between the maximum value held in the overall-page maximum value register and the current value of the output of the US sensor is equal to or less than a predetermined value (e.g., 35% of the maximum value).

Next, when verifying that the difference is the predetermined value or less (Yes at Step SD2), the attached-portion lower-end detecting unit 104*e* recognizes that the lower end of the attached portion has been detected, and stores the maximum value held in the attached-portion maximum value register and the minimum value held in the attached-portion minimum value register in association with each other in a predetermined area of the holding unit 106 (Step SD3).

Then, the attached-portion lower-end detecting unit 104*e* clears the overall-page minimum value register, the attached-portion maximum value register, the attached-portion minimum value register, and the attached-portion upper-end detection flag (Step SD4).

The explanation on the attached-portion lower-end detection process is ended herein.

Referring back to FIG. 6, when the trailing edge of the fed paper has not reached the US sensor of the multifeed detecting unit 112 and the multifeed detecting unit 112 has not ended the MF detection (No at Step SA8), the control unit 104 causes the processing units to execute the processes at Step SA3 to Step SA7. It should be noted that the detection of the attached portion (Step SA5 to Step SA7) can be executed until the number reaches the predetermined upper limit of recognized attached portions.

Next, when the trailing edge of the fed paper has reached the US sensor of the multifeed detecting unit 112 and the multifeed detecting unit 112 has ended the MF detection (Yes at Step SA8), the control unit 104 acquires the result of MF detection ("Occurrence of MF" or "No MF") by the multifeed detecting unit 112 therefrom (Step SA9: US-sensor MF-detection ending process).

Next, the attached-portion/multifeed determining unit 104*f* executes the following attached-portion/MF determination process and determines "Occurrence of MF" or "No MF" (Step SA10).

Figure 10:
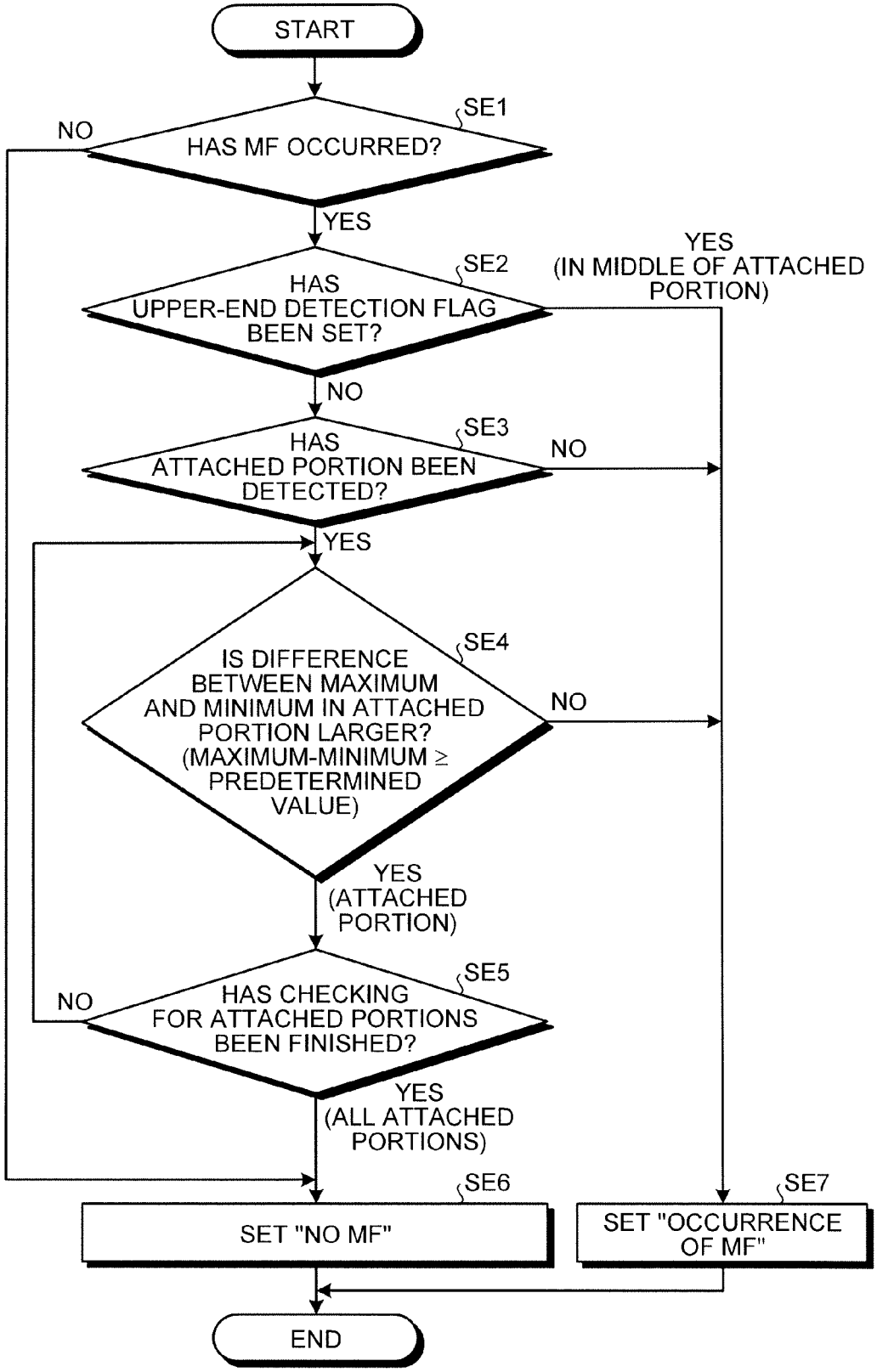
FIG. 10 is a flowchart representing one example of an attached-portion/MF determination process according to the present embodiment.

Here, one example of the attached-portion/MF determination process will be explained with reference to FIG. 10. FIG. 10 is a flowchart representing one example of the attached-portion/MF determination process according to the present embodiment.

First, when the result of MF detection acquired at Step SA9 is "Occurrence of MF" (Yes at Step SE1), the attached-portion/multifeed determining unit 104*f* checks whether the attached-portion upper-end detection flag has been set. When the result of MF detection is "No MF" (No at Step SE1), the attached-portion/multifeed determining unit 104*f* sets "No MF" as per the result of detection by the multifeed detecting unit 112 (Step SE6).

Next, when verifying that the attached-portion upper-end detection flag has not been set (No at Step SE2), the attached-portion/multifeed determining unit 104*f* checks whether the attached portion has been detected from the paper using the value held in the flag indicating number of recognized attached portions. When verifying that the attached-portion upper-end detection flag has been set (Yes at Step SE2), the attached-portion/multifeed determining unit 104*f* recognizes that the trailing edge of the paper has reached the US sensor in the middle of the attached portion, and sets "Occurrence of MF" as per the result of detection by the multifeed detecting unit 112 (Step SE7).

Next, when verifying that the attached portion has been detected from the paper (Yes at Step SE3), the attached-portion/multifeed determining unit 104*f* checks whether a difference between the maximum value and the minimum value of the attached portion held in the holding unit 106 is equal to or more than a predetermined value (e.g., 40% of the maximum value). When verifying that the attached portion has not been detected from the paper (No at Step SE3), the attached-portion/multifeed determining unit 104*f* sets "Occurrence of MF" as per the result of detection by the multifeed detecting unit 112 (Step SE7).

Next, when verifying that the difference is the predetermined value or more (Yes at Step SE4), the attached-portion/multifeed determining unit 104*f* recognizes that the attached portion is caused by an attached matter such as a seal. When verifying that the difference is not equal to or more than the predetermined value (No at Step SE4), the attached-portion/multifeed determining unit 104*f* sets "Occurrence of MF" as per the result of detection by the multifeed detecting unit 112 (Step SE7).

Next, the attached-portion/multifeed determining unit 104*f* checks whether checking for the maximum value and minimum value of all the attached portions has been finished.

Next, when verifying that the checking for all the attached portions has not been finished (No at Step SE5), the attached-portion/multifeed determining unit 104*f* executes again the checking whether a difference between the maximum value and the minimum value of the attached portion, held in the holding unit 106, which is not yet checked is equal to or more than the predetermined value, and returns to Step SE4.

Next, when verifying that the checking for all the attached portions has been finished (Yes at Step SE5), the attached-portion/multifeed determining unit 104*f* recognizes that all the attached portions are caused by attached matters such as a seal, ignores the result of detection by the multifeed detecting unit 112, and sets "No MF" (Step SE6).

The explanation on the attached-portion/MF determination process is ended herein.

Referring back to FIG. 6, when the attached-portion/MF determination result in the attached-portion/MF determination process is "Occurrence of MF" ("Occurrence of MF" at Step SA11), the control unit 104 performs ordinary handling of occurrence of MF (Step SA12).

When the attached-portion/MF determination result in the attached-portion/MF determination process is "No MF" ("No MF" (attached portion etc.) at Step SA11), the control unit 104 causes the image reading unit 114 not to stop the reading operation but to continue the operation as it is (Step SA13).

The explanation on the US-sensor MF detection process is ended herein.

4. Summary of Present Embodiment, and Other Embodiments

As mentioned above, according to the present embodiment, in a case where a large variation (high→low, low→high) of a US-sensor output is captured and an output variation during the variation is a predetermined value or more, this case is recognized as an attached portion, thus preventing this case from being detected as MF.

Specifically, the maximum value and the minimum value of the US-sensor outputs are held, and an area where the minimum value largely varies (high→low) is determined as the upper end of an attached portion. An area from the upper end of the attached portion to the lower end of the attached portion is determined as the attached portion, and the maximum value and the minimum value of the US-sensor outputs are separately held. Then, an area where the current value as the US-sensor output largely varies (low→high) and is returned to a value near the maximum value is determined as the lower end of the attached portion. When the amount of variation in US-sensor output in the attached portion is a predetermined value or more, this case is recognized as an attachment and MF is ignored.

In this way, the attached portion on the paper can be accurately detected without troublesome operation, and thus it is possible to automatically ignore the detection of MF caused by a medium such as a seal purposely attached to the paper.

Moreover, the present invention may be implemented in various different embodiments in the scope of technical idea described in the appended claims other than the embodiment. For example, of the processes explained in the embodiment, all or part of the processes explained as automatically performed ones can be manually performed, or all or part of the processes explained as manually performed ones can be also automatically performed using known methods. A specific configuration of distribution or integration of the apparatuses is not limited to the illustrated one. The apparatuses can be configured by functionally or physically distributing or integrating all or part of the apparatuses in arbitrary units according to various types of additions or the like or according to functional loads. In addition, the process procedures, the control procedures, the specific names, and the screen examples shown in the present specification and the drawings can be arbitrarily modified unless otherwise specified.

The constituent elements of the image reading apparatus 100 shown in the drawings are functionally conceptual, and need not be physically configured as illustrated. For example, for the process functions provided in the image reading apparatus 100, especially for the process functions performed in the control unit 104, all or part thereof may be implemented by a CPU and programs interpreted and executed in the CPU, and may be implemented as hardware by wired logic. The programs are recorded in a recording medium, explained later, and they are mechanically loaded into the image reading apparatus 100 as required. More specifically, computer programs to perform various processes are recorded in ROM or an HD (Hard Disk). The computer programs are executed by being loaded into RAM, and form the control unit in cooperation with the CPU.

The image reading apparatus according to the present invention can be achieved by installing software (including the programs, the data, and the like) to implement the multifeed determining method according to the present invention. The multifeed determining program according to the present invention may be stored in a computer-readable recording medium, or can be configured as a program product. The "recording medium" mentioned here includes any "portable physical medium" such as a flexible disk, a magneto-optical disc, ROM, EPROM (Erasable Programmable Read Only Memory), EEPROM (Electronically Erasable and Programmable Read Only Memory), CD-ROM (Compact Disk Read Only Memory), MO (Magneto-Optical disk), and a DVD (Digital Versatile Disk) or includes a "communication medium" that temporarily holds a program, such as a communication line and a carrier used to transmit the program through a network such as LAN (Local Area Network), WAN (Wide Area Network), and the Internet. The "program" mentioned here is a data processing method described in an arbitrary language and description method, and thus any form such as a source code and a binary code is acceptable. It should be noted that the "program" is not necessarily limited to a program configured as a single unit, and, therefore, includes those distributedly configured as a plurality of modules and libraries and those in which the function of the program is achieved in cooperation with separate programs represented as OS. Regarding a specific configuration and a reading procedure to read a recording medium by the apparatuses shown in the embodiments, or an installation procedure after the reading, or the like, known configuration and procedures can be used.

According to the present invention, (i) an attached portion on a paper is detected from an output of an ultrasonic sensor for the paper fed, and (ii) when it is detected as "Occurrence of multifeed" by a multifeed detecting mechanism and if an amount of variation in the output within the detected attached portion is equal to or more than a first predetermined value, a result of detection as the occurrence of multifeed by the multifeed detecting mechanism is ignored and the detection is determined as "No multifeed". Thus, there is such an effect that a multifeed detected caused by a medium such as a purposely attached seal can be automatically ignored without causing the operator to carry out complicated and troublesome operations.

According to the present invention, (i) an area where a difference between a minimum value and a maximum value of the output of the ultrasonic sensor is equal to or more than a second predetermined value, is detected as an upper end of the attached portion, and (ii) an area where a difference between the output of the ultrasonic sensor and the maximum value after the upper end is detected is equal to or less than a third predetermined value, is detected as a lower end of the attached portion. Thus, there is such an effect that an attached portion on the paper can be accurately detected.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image reading apparatus comprising:

a multifeed detecting mechanism including an ultrasonic sensor; and a control unit, wherein the control unit includes a detecting unit that detects an attached portion on a paper from an output of the ultrasonic sensor for the paper fed, and a determining unit that ignores, when it is detected as an occurrence of multifeed by the multifeed detecting mechanism and if an amount of variation in the output within the attached portion detected by the detecting unit is equal to or more than a first predetermined value, a result of detection as the occurrence of multifeed by the multifeed detecting mechanism, and determines the detection as a no multifeed.

2. The image reading apparatus according to claim 1, wherein the detecting unit detects an area, where a difference between a minimum value and a maximum value of the output of the ultrasonic sensor is equal to or more than a second predetermined value, as an upper end of the attached portion, and detects an area, where a difference between the output of the ultrasonic sensor and the maximum value after the upper end is detected is equal to or less than a third predetermined value, as a lower end of the attached portion.

3. A multifeed determining method implemented by a control unit of an image reading apparatus that includes a multifeed detecting mechanism including an ultrasonic sensor, and the control unit, the multifeed determining method comprising:

a detecting step of detecting an attached portion on a paper from an output of the ultrasonic sensor for the paper fed; and a determining step of ignoring, when it is detected as an occurrence of multifeed by the multifeed detecting mechanism and if an amount of variation in the output within the attached portion detected at the detecting step is equal to or more than a first predetermined value, a result of detection as the occurrence of multifeed by the multifeed detecting mechanism, and determining the detection as a no multifeed.

4. A multifeed determining program product that makes a control unit of an image reading apparatus that includes a multifeed detecting mechanism including an ultrasonic sensor, and the control unit implement a multifeed determining method, the multifeed determining method comprising:

a detecting step of detecting an attached portion on a paper from an output of the ultrasonic sensor for the paper fed; and a determining step of ignoring, when it is detected as an occurrence of multifeed by the multifeed detecting mechanism and if an amount of variation in the output within the attached portion detected at the detecting step is equal to or more than a first predetermined value, a result of detection as the occurrence of multifeed by the multifeed detecting mechanism, and determining the detection as a no multifeed.

* * * * *